United States Patent [19]

Lund et al.

[11] Patent Number: 4,682,310

[45] Date of Patent: Jul. 21, 1987

[54] ARTICLE WITH ELECTRIC TIMEPIECE

[75] Inventors: Eric W. Lund; Raymond W. Young, both of West Bend, Wis.

[73] Assignee: Amity Leather Products Company, West Bend, Wis.

[21] Appl. No.: 734,336

[22] Filed: May 14, 1985

[51] Int. Cl.[4] ..... G04B 37/00; A44C 5/00

[52] U.S. Cl. ..... 368/278; 150/131; 150/145; 224/152; 224/903; 248/114

[58] Field of Search ..... 150/106, 131, 138, 145; 224/901, 903, 152; 248/114–116; 368/88, 276–278, 283, 286, 316–318, 10

[56] References Cited

U.S. PATENT DOCUMENTS

| | | | |
|---|---|---|---|
| D. 37,788 | 1/1906 | Schickerling | D3/57 |
| D. 46,332 | 9/1914 | Cohn | D3/57 |
| D. 133,556 | 8/1942 | Wege | D3/58 |
| 1,381,018 | 6/1921 | Rogers | 224/903 |
| 1,443,633 | 1/1923 | Milne | 248/115 |
| 1,560,442 | 11/1925 | Trowbridge | 150/112 |
| 1,871,898 | 8/1932 | Manheimer | 368/10 |
| 2,094,322 | 9/1937 | Hannings | 206/37 |
| 2,124,945 | 7/1938 | Gross | 58/88 |
| 2,342,804 | 2/1944 | Hiller | 368/316 |
| 2,540,501 | 2/1951 | Adams | 248/115 |
| 2,576,476 | 11/1951 | Peter et al. | 58/88 |
| 2,596,131 | 5/1952 | Darby et al. | 150/145 |
| 2,635,416 | 4/1953 | Mietchen | 368/283 |
| 3,763,646 | 10/1973 | Jeanmonod | 224/903 |
| 4,310,908 | 1/1982 | Fuerneisen | 368/88 |

FOREIGN PATENT DOCUMENTS

| | | | |
|---|---|---|---|
| 760165 | 2/1934 | France . | |
| 12415 | 7/1896 | Switzerland . | |
| 131706 | 2/1929 | Switzerland . | |
| 137354 | 3/1930 | Switzerland | 368/278 |
| 156624 | 8/1932 | Switzerland . | |

*Primary Examiner*—Vit W. Miska

*Attorney, Agent, or Firm*—Fitch, Even, Tabin & Flannery

[57] ABSTRACT

A timepiece that may be associated with a billfold in which the incorporation of the timepiece into the billfold does not significantly affect either the configuration or usage of the billfold.

A battery-powered digital watch includes a printed circuitboard that is oversized to provide a flange that extends beyond the periphery of the watch cover. The wallet into which the timepiece is to be incorporated includes a cutout in its cover or a pocket sized to receive the cover member of the watch to permit viewing of the digital display, but to prevent the flange from passing therethrough. The timepiece is secured in place by an adhesive-bearing web overlying the backsides of both the flange and the wallet member through which the watch is viewed. Alternatively, or additionally, adhesive may be applied to the frontside of the flange that interfaces with the backside of the wallet member.

6 Claims, 4 Drawing Figures

ARTICLE WITH ELECTRIC TIMEPIECE

The present invention relates to billfolds or pocketbooks and, more particularly, to billfolds or pocketbooks having integral timepieces.

BACKGROUND OF THE INVENTION

As lifestyles have become become increasingly fast-paced, there has been a concomitant increase in people's consciousness of time, with clocks and watches of various sorts becoming a necessity for functioning in society. Although clocks and watches have become almost ubiquitous, situations always seem to arise where a watch is needed, but is not readily available. Another necessity for day-to-day life is to be constantly in possession of identification, credit cards, currency, etc., which are typically carried in a wallet or billfold. And, not surprisingly, there are occasions where need for both of these items might coincide, as when one needs to date a check during its execution.

SUMMARY OF THE INVENTION

Thus, it is the primary object of the present invention to concurrently meet these two distinct needs by the provision of a timepiece that may be uniquely associated with a billfold in which the incorporation of the timepiece into the billfold does not significantly affect either the configuration or usage of the billfold.

This object, as well as others that will become apparent upon reference to the accompanying drawings and detailed description, is met by a battery-powered digital watch in which the printed circuitboard for the watch is oversized to provide a flange that extends beyond the periphery of the watch cover. The wallet into which the timepiece is incorporated includes a cutout in either its cover or a pocket therein, the cutout being sized to receive the cover member of the watch to permit viewing of the digital display, but to prevent the flange from passing therethrough. The timepiece is secured in place by an adhesive-bearing web overlying the backsides of both the flange and the wallet member through which the watch is viewed. Alternatively, or additionally, adhesive may be applied to the frontside of the flange that interfaces with the backside of the wallet member.

DETAILED DESCRIPTION OF THE PREFERRED EMBODIMENT

Figure 1:
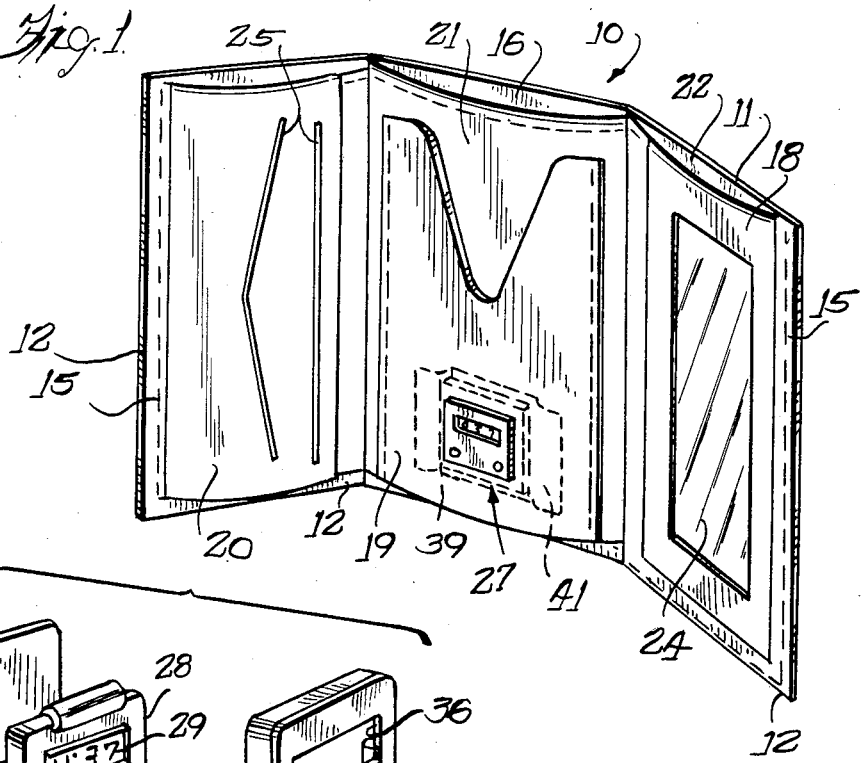
FIG. 1 is a perspective view of an open billfold embodying the present invention.

Turning to the drawings, there is seen in FIG. 1 a perspective view of an open wallet or billfold, generally indicated at 10, of a type that folds into thirds along its length. Such a billfold is typically made of cowhide, but may be constructed of any similarly pliable natural or synthetic material, such as vinyl.

The wallet 10 is of conventional configuration and construction and sized, when folded, to fit conveniently into the owner's pocket. The wallet 10 includes an exterior cover 11 with its marginal edge 12 folded back to form a hem 14 and stitched at 15 to secure a fabric lining 16 and pocket pieces 18–20 to a stay or stay facing 21. The illustrated wallet 10 includes a bill or currency pocket 22, an open I.D. window 24 associated with pocket 18, and credit card slots 25 associated with pocket 20.

In accordance with the present invention, a timepiece is integrally associated with the billfold, with the timepiece being viewable through a cutout in one of the leather pieces making up the billfold. The face of the timepiece is substantially flush with respect to the surface of the leather piece through which the timepiece may be viewed so as to not significantly affect the thickness of the billfold. Returning to the drawings, a timepiece, indicated generally at 27, is integrally associated with the billfold 10 in such a manner that the timepiece is visible when the wallet is opened, and, upon folding the billfold, is disposed on the interior thereof.

Figure 2:
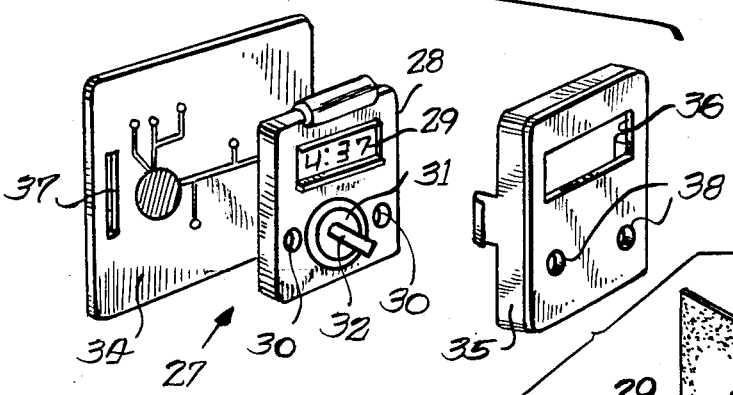
FIG. 2 is an exploded perspective view showing the components of a watch for use in combination with the present invention.

Preferably, the watch 27, better seen in FIG. 2, is a battery-powered, multi-function, liquid crystal display (L.C.D.) digital watch. Such watches, although relatively inexpensive, are highly accurate, durable, and sufficiently thin (less than 3/32 in. in thickness) so as to not change the configuration of the assembled wallet 10 to which the watch 27 is joined, or to substantially affect the wallet's ability to conform to the contours of the owner's pocket. The watch 27 comprises a molded plastic body 28 that houses a digital display 29. Function adjustment buttons 30 for changing the time or date shown on the display 29 are recessed within the plastic body 28 so as to prevent accidental contact therewith. The body 28 also houses a battery 31 and a conductor 32 in contact with one of the poles of the battery 31. The watch body 28 is secured to a printed circuit board 34 to complete the circuitry of the timepiece 27. A removable metal cover 35 overfits the plastic body 28 and has a cutout 36 to permit viewing of the digital display 29 and holes 38 therein aligned with the function adjustment buttons 30 to permit the manipulation thereof by the tip of a pencil or the like, thus permitting only intended, rather than accidental, actuation of the function buttons 30. As illustrated, the circuitboard 34 includes two slots 37 disposed on opposite sides of the plastic body 28 for receiving tabs 40 integral with the metal cover 35 to removably secure the cover 35 to the circuitboard 34. The height of the combination of the cover 35 and plastic body 28 is substantially the same as the thickness of the leather used in constructing the billfold 10.

Figure 3:
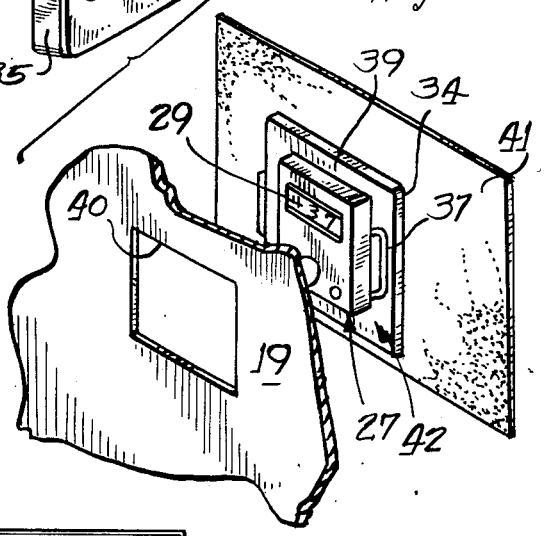
FIG. 3 is an exploded perspective view showing the manner in which the watch is secured to the billfold.

In keeping with the invention, the watch is provided with means for securing it to the billfold. With reference to FIG. 3, the printed circuitboard 34 is sized to extend beyond the edges of the cover 35 so that, when the watch body 28 and cover 35 are secured to the printed circuitboard 34, the marginal edge portions of the printed circuitboard 34 form a flange area 39 to be used in mounting the timepiece 27 on the billfold 10.

To mount the timepiece 27 to the billfold 10, one of the center pockets 19 includes a cutout 40 substantially centered therein and sized to receive the removable cover 35 therethrough, but to prevent the passage of the circuitboard 34. It has been found that a flange portion 39 approximately 3/16 in. in width provides sufficient hindrance to prevent the passage of the circuitboard through the cutout.

Once in place, the timepiece 27 is adhesively secured to the backside of the leather pocket 19. Referring to FIG. 3, the timepiece is centered with respect to the cutout 40 in the pocket and then placed so that the cover 35 fits within the cutout 40 so as to contact the edges thereof. A web of adhesive tape 41, preferably made of cloth, is placed over the flange on the backside of the pocket 19 to securely hold the timepiece 27 with the adhesive side of the tape 41 facing the backside of the pocket 19. Alternatively, or additionally, the flange 39 may also receive adhesive on the portion that interfaces with the leather pocket 19. In one form, the adhesive is applied to the circuitboard 34 before assembly and covered with a tape 42 that is peeled to expose the adhesive prior to attachment of the timepiece 27 to the wallet 10. After the timepiece is secured to the backside of the pocket 19, the pocket may be stitched to the remainder of the wallet 10 in the conventional manner.

From the foregoing it can be seen that a watch for incorporation into a wallet has been provided wherein the watch does not significantly affect either the configuration or use of the wallet. Because of the thinness of the timepiece, when it is incorporated into the wallet it is substantially flush with the surface of the leather piece through which it is placed. Further, little additional labor is involved in the construction of the inventive combination as the billfold does not have to be changed, other than the cutout, to accommodate the timepiece.

Figure 4:
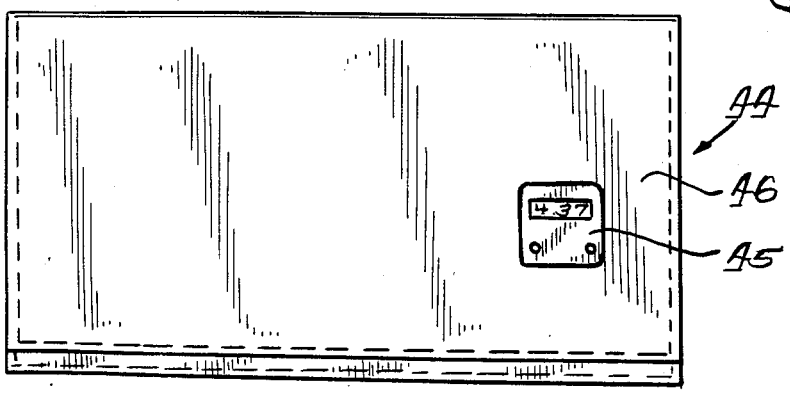
FIG. 4 is a plan view of an alternate embodiment of the present invention in which a watch is associated with a checkbook cover.

While the invention has been described in terms of a preferred embodiment, there is is no intent to limit the invention by such disclosure. Rather, it is intended to cover all modifications and constructions falling within the spirit and scope of the invention as defined in the appended claims. For example, the timepiece may be associated with a checkbook clutch or cover 44 as illustrated in FIG. 4. In such an embodiment, the watch 45 is secured in the manner discussed above to the exterior cover 46 of the clutch 44 so as to be viewable through an opening therein. Further, such a flange-mounted timepiece can be secured in a similar manner, or by other means such as riveting, stapling or stitching, to other personal leather goods having different layers of materials, such as a fob for a keyring. And, although the described embodiment includes a wallet made of leather, any leather-like material, such as vinyl, could be used.

What is claimed is:

1. A pocket-sized leather product having a timepiece integrally associated therewith comprising, in combination, a battery-powered watch mounted on an integral oversized, planar flange and having a cover member, the planar flange having a marginal edge portion extending beyond the edges of the cover member and comprising a printed circuit board of operating the battery-powered watch;

a multi-layer leather product having a cutout in its outer layer sized to receive the cover member of the watch in substantially flush relationship to the outer layer; and means for securing the watch to the leather product by means of the oversized flange.

2. A billfold having a timepiece integrally associated therewith comprising, in combination, a battery-powered watch mounted on an integral oversized, planar flange and having a cover member, the planar flange having a marginal edge portion extending beyond the edges of the cover member and comprising a printed circuit board for operating the battery-powered watch;

a billfold made of flexible, leather-like material and having a cutout therein sized to receive the cover member of the timepiece therethrough;

means for securing the watch to the billfold by means of the oversized flange.

3. The combination of claim 2 wherein the securing means comprises adhesive between the interfacing marginal edge portion of the flange and the billfold.

4. The combination of claim 2 wherein the securing means comprises a web adhesively secured to the backside of the flange and the underside of the billfold.

5. The combination of claim 2 wherein the cover has tabs at the peripheral edges thereof and the flange has slots inward of its edge for receiving the tabs of the cover to secure said cover to the flange.

6. The combination of claim 2 wherein the marginal edge portion of the flange is approximately 3/16 in. in width.

* * * * *